United States Patent [19]

Franklin et al.

[11] Patent Number: 5,019,329

[45] Date of Patent: May 28, 1991

[54] SYSTEM AND METHOD FOR VERTICALLY FLUSHING A STEAM GENERATOR DURING A SHOCK WAVE CLEANING OPERATION

[75] Inventors: Richard D. Franklin, Hemet, Calif.; Gregg D. Auld, Trafford; David E. Murray, Connellsville, both of Pa.

[73] Assignee: Westinghouse Electric Corp., Pittsburgh, Pa.

[21] Appl. No.: 456,436

[22] Filed: Dec. 26, 1989

[51] Int. Cl.[5] ..... G21C 19/42

[52] U.S. Cl. ..... 376/316; 376/310; 134/22.18; 122/382; 122/392

[58] Field of Search ..... 376/310, 316; 134/22.18; 122/382, 392

[56] References Cited

U.S. PATENT DOCUMENTS

| | | | |
|---|---|---|---|
| 2,716,021 | 8/1955 | Evans et al. | 257/1 |
| 3,913,531 | 10/1975 | von Hollen | 122/32 |
| 4,079,701 | 3/1978 | Hickman et al. | 122/382 |
| 4,079,782 | 3/1978 | Soderberg et al. | 165/95 |
| 4,566,406 | 1/1986 | Appleman | 122/405 |
| 4,620,881 | 11/1986 | Booij | 134/21 |
| 4,655,846 | 4/1987 | Scharton et al. | 134/1 |
| 4,699,665 | 10/1987 | Scharton et al. | 134/1 |
| 4,705,057 | 11/1987 | Mohr et al. | 134/180 |
| 4,756,770 | 7/1988 | Weems et al. | 134/37 |
| 4,773,357 | 9/1988 | Scharton et al. | 122/382 |
| 4,905,900 | 3/1990 | Scharton et al. | 239/99 |
| 4,921,662 | 5/1990 | Franklin et al. | 376/316 |

*Primary Examiner*—Brooks H. Hunt
*Assistant Examiner*—N. Bhat

[57] ABSTRACT

Both a system and a method for removing sludge and debris from the interior of the secondary side of a nuclear steam generator is disclosed. The method comprises the steps of introducing a sufficient amount of water in the secondary side to submerge at least the tubesheet, generating a succession of shock waves in the water by means of pulses of pressurized gas to create shock waves that loosen the sludge and debris, and vertically flushing the interior of the secondary side by suctioning water off from the bottom portion of the steam generator while simultaneously forcefully spraying water from the top portion of the generator over the bundle of heat exchanger tubes in order to remove the sludge and debris loosened by the shock waves. To conserve the water used in the flushing operation, the water that is suctioned off from the bottom portion of the steam generator is filtered and de-ionized and reintroduced through hoses at the top portion of the generator which forcefully directs water downwardly through the bundle of heat exchanger tubes and against the tubesheet. The invention greatly enhances the effectiveness of pressure pulse, water slap and water cannon cleaning methods in the secondary sides of nuclear steam generators.

29 Claims, 6 Drawing Sheets

SYSTEM AND METHOD FOR VERTICALLY FLUSHING A STEAM GENERATOR DURING A SHOCK WAVE CLEANING OPERATION

BACKGROUND OF THE INVENTION

This invention generally relates to the cleaning of heat exchanger vessels, and is specifically concerned with a system and method for vertically flushing the secondary side of a nuclear steam generator during a pressure pulse or other shock-wave type cleaning operation.

Methods for cleaning the interior of the secondary side of a nuclear steam generator by means of shock waves introduced into water are known in the prior art. In all of these methods, the nuclear steam generator is shut down and drained. Next, enough de-mineralized water is introduced into the secondary side to completely submerge the tubesheet and the bottom ends of the bundle of heat exchanger tubes mounted therein. Shock waves are then introduced into this water to loosen sludge and debris that accumulates around the top side of the tubesheet and the bottom ends of the heat exchanger tubes. Such shock waves may be generated by directly introducing a pressurized pulse of an inert gas within the water to produce an explosive, omnidirectional shock wave that impinges against all the heat exchanger components that are submerged within the water present in the secondary side of the generator. Alternatively, these shock waves may take the form of forceful fountains of water which erupt from the surface of the water collected within the secondary side and forcefully slap against the sludge-collecting spaces between the heat exchanger tubes and support plates to clean them. In still another type of shock wave cleaning process, a water cannon powered by pressurized pulses of gas is used to generate high velocity bursts of water below the water level which forcefully impinge against collected sludge and debris, thereby loosening and removing it. In all three methods, a gas operated pressure pulse generator is used to generate the shock waves which loosen the sludge and debris, either directly as illustrated for example in the pressure pulse cleaning techniques disclosed in U.S. Pat. Nos. 4,655,846 and 4,699,665, or indirectly through water slap and water cannon techniques as illustrated in U.S. Pat. Nos. 4,756,770 and 4,773,357, respectively. In all of these techniques, the same water that is used to propagate the sludge-loosening shock waves is continuously recirculated through the hand-holes located at the bottom of the steam generator and filtered in much the same manner as an ordinary pool vacuum in order to entrain and remove the sludge and other debris loosened by the shock waves.

Since their inception, such shock wave cleaning techniques have shown themselves to be a very promising way in which to remove the stubborn deposits of sludges which tend to accumulate not only on the upper surface of the tubesheet, but in the small annular spaces between the support plates and the heat exchanger tubes which are present inside the secondary side of such generators. However, the applicants have found that all of these shock wave cleaning techniques have fallen short of fulfilling their full potential due to the lack of effectiveness of the water circulation employed to entrain and remove the loosened particles of sludge and debris out of the secondary side of the steam generator. In all of these techniques, water is circumferentially circulated around the bottom of the secondary side just above the tubesheet by pumps which simultaneously inject and withdraw the water out through the sludge lancing ports of the steam generator. While such a flow of water effectively removes sludge and debris directly in front of the discharge and withdrawal ports of the re-circulation system and around the edges of the tubesheet where the concentration of heat exchanger tubes is at its lowest density, the applicants have found that the currents generated by such re-circulation systems are ineffective in sweeping the sludge and debris which accumulates on and around the central portion of the tubesheet where the density of the bundle of heat exchanger tubes is greatest. If this dislodged sludge is not removed from the center portion of the tubesheet, the fine particles which constitute such sludge are capable of settling onto the tubesheet and densely depositing themselves into the crevice regions between the tubesheet and the legs of the heat exchanger tubes mounted therein, thereby defeating one of the primary purposes of the cleaning operation. Of course, such sludge can be removed by conventional sludge-lancing techniques. However, the addition of another major step in the cleaning operation protracts the time necessary to complete the cleaning operation by as much as a half a day. This is a significant drawback, as a utility typically looses over $500,000 in revenues per each day of downtime.

Clearly, there is a need for an improved recirculation system for use in conjunction with a shock wave cleaning operation of a nuclear steam generator which effectively entrains and removes all the sludge and debris loosened by the shock waves without adding any significant amount of time to the cleaning operation. Ideally, such a re-circulation system should improve the efficiency of the cleaning operation without adding any significant expenses in set up time or equipment costs. Finally, the new re-circulation system should be compatible with all types of shock wave cleaning techniques, including pressure pulse, water cannon and water slap cleaning techniques.

SUMMARY OF THE INVENTION

Generally speaking, the invention is both a system and a method for loosening and removing sludge and debris from the interior of the vessel of a heat exchanger, which may be a nuclear steam generator, that contains one or more heat exchanger components, such as tubes, a tubesheet, and support plates.

The method comprises the steps of introducing a sufficient amount of liquid, such as water, in the heat exchanger vessel to submerge at least a portion of the interior thereof, generating a succession of shock waves within the liquid to loosen sludge and debris from the heat exchanger components within the vessel, and vertically flushing the interior of the vessel by suctioning liquid from the bottom portion of the vessel while simultaneously introducing liquid into the top portion of the vessel. Preferably, a succession of shock waves continues to be generated within the liquid while the interior of the vessel is vertically flushed.

The liquid used to vertically flush the interior of the vessel may also be used to fill the vessel to a level which completely submerges all of the heat exchanger components therein by merely suctioning the liquid out of the vessel at a rate slower than liquid is introduced at the top of the vessel. Conversely, draining all of the liquid out of the vessel is accomplished by merely suctioning liquid out of the vessel at a rate faster than liquid is introduced into the top portion of the vessel. The flow rate of the liquid suctioned out of the bottom portion of the vessel is fast enough to entrain and remove sludge and debris from the interior of the vessel. Preferably, the same liquid suctioned from the bottom portion of the vessel is recirculated and re-introduced into the top portion of the vessel after the sludge and debris entrained therein has been removed by suitable filtration assemblies in order to conserve the amount of liquid needed to implement the vertical flush. Additionally, the liquid introduced into the top portion of the vessel is preferably forcefully sprayed over the heat exchanger components contained therein in order to enhance the effectiveness of the vertical flush in removing sludge and debris.

When the method of the invention is applied to the secondary side of a nuclear steam generator, a sufficient amount of water is first introduced into the secondary side to immerse at least the tubesheet and the lower ends of the heat exchanger tubes. Next, a succession of pressure pulses is generated within the water collected within the secondary side by means of pulses of pressurized gas to create shock waves that loosen the sludge and debris. These shock waves may be in the form of omnidirectional shock waves of water created by the pulses of pressurized gas discharged into the water. Alternatively, these shock waves may be either in the form of fountains of water that erupt above the surface of the water and forcefully slap against the heat exchanger components, or even projectiles of water that are discharged below the water level by a water cannon.

As soon a sufficient amount of water is collected within the secondary side to allow debris and sludge loosening shock waves to be effectively generated within the secondary side, the interior of the secondary side is vertically flushed by suctioning water through the sludge lance ports in the pressure vessel located at the bottom portion of the generator while forcefully spraying water down over the tube bundle through special hoses inserted through the manways located in the swirl vane area of the generator. While the succession of shock waves continues to be generated, the secondary side is slowly filled with water to a level that completely immerses the bundle of heat exchanger tubes contained therein by introducing water at a rate of 100 gallons per minute while suctioning water at a rate of only 80 gallons per minute. This filling step of the method preferably lasts between about 12 and 20 hours, depending upon the condition of the secondary side. After the bundle of heat exchanger tubes has been completely submerged, both the filling rate and the suctioning rate are set at equilibrium for a period of between 6 and 24 hours, and preferably between 6 and 8 hours while the succession of shock waves continues. Finally, the secondary side is drained of water by suctioning the water out of the bottom portion of the steam generator at a rate of about 100 gallons per minute while filling it at the top portion at a rate of only about 80 gallons per minute. This draining step takes between about 12 and 20 hours, again depending upon the condition of the nuclear steam generator.

The system of the invention generally comprises means for generating shock waves in liquid collected within the heat exchanger, which may be a pressure pulse generator that discharges pulses of pressurized gas into the liquid, as well as means for vertically flushing the heat exchanger components while the shock wave generator means creates sludge loosening shock waves within the liquid. In the preferred embodiment, the flushing means is the combination of a suction and discharge pump, one or more suction nozzles connected to the inlet end of the pump for sucking out water and sludge entrained therein, one or more discharge nozzles connected to the discharge end of the pump for directing a forceful spray of water over the components within the heat exchanger vessel to entrain loosened sludge into the water, and a filtration assembly for removing not only the sludge and debris entrained within the water that is sucked out of the bottom of the heat exchanger vessel, but also any dissolved ionic species that may be present in the liquid.

Both the method and the system of the invention greatly enhance both the effectiveness and the speed of cleaning techniques which utilize shock waves to loosen and remove sludge and debris from the interior of heat exchanger vessels, such as pressure pulse, water slap and water cannon cleaning techniques.

BRIEF DESCRIPTION OF THE SEVERAL FIGURES

DETAILED DESCRIPTION OF THE PREFERRED EMBODIMENT

General Overview Of The Application Of The Invention

Figure 1:
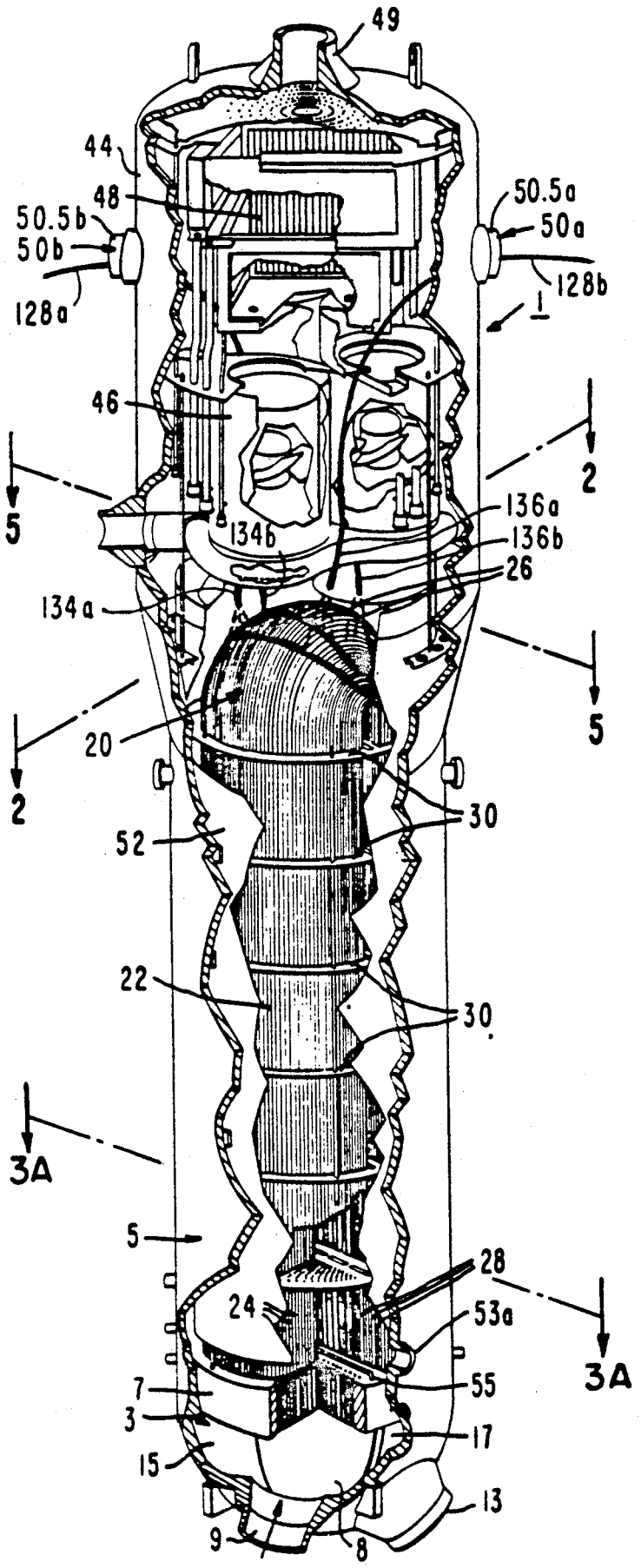
FIG. 1 is a perspective view of a nuclear steam generator with part of its exterior walls removed to display the interior of the generator, and the manner in which the discharge nozzles of the system of the invention are mounted through the manways located at the top of the secondary side.
Figure 2:
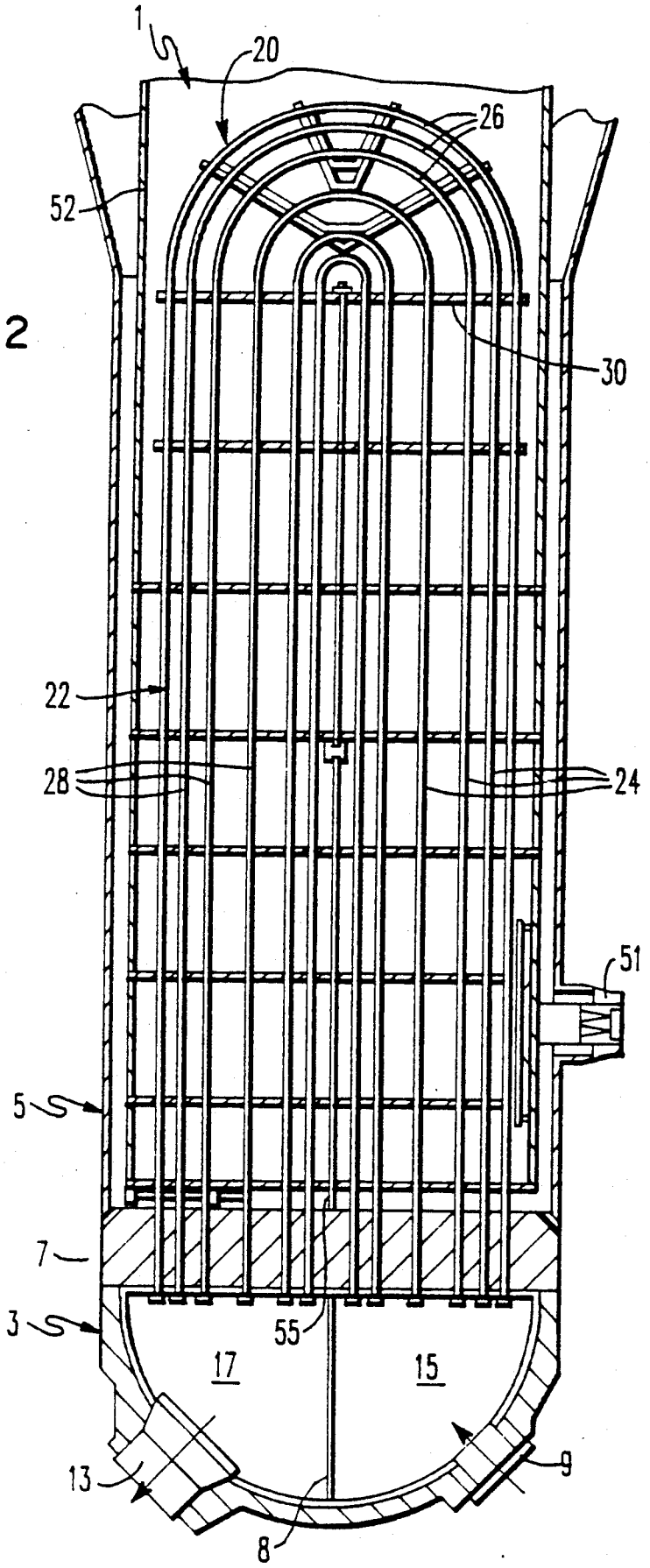
FIG. 2 is a side, cross-sectional view of the steam generator illustrated in FIG. 1 along the line 2—2.

With reference now to FIGS. 1 and 2, wherein like numerals designate like components throughout all of the several figures, the system and method of the invention are both particularly adapted for assisting a pressure pulse cleaning system in removing sludge which accumulates within a nuclear steam generator 1. But before the application of the invention can be fully appreciated, some understanding of the general structure and the maintenance problems associated with such steam generators 1 is necessary.

Nuclear steam generators 1 generally include a primary side 3 and a secondary side 5 which are hydraulically isolated from one another by a tubesheet 7. The primary side 3 is bowl-shaped, and is divided into two, hydraulically isolated halves by means of a divider plate 8. One of the halves of the primary side 3 includes a water inlet 9 for receiving hot, radioactive water that has been circulated through the core barrel of a nuclear reactor (not shown), while the other half includes a water outlet 13 for discharging this water back to the core barrel. This hot, radioactive water circulates through the U-shaped heat exchanger tubes 22 contained within the secondary side 5 of the steam generator 1 from the inlet half of the primary side 3 to the outlet half (see flow arrows). In the art, the water-receiving half of the primary side 3 is called the inlet channel head 15, while the water-discharging half is called the outlet channel head 17.

The secondary side 5 of the steam generator 1 includes an elongated tube bundle 20 formed from approximately 3500 U-shaped heat exchanger tubes 22. Each of the heat exchanger tubes 22 includes a hot leg, a U-bend 26 at its top, and a cold leg 28. The bottom end of the hot and cold legs 24, 28 of each heat exchanger tube 22 is securely mounted within bores in the tubesheet 7, and each of these legs terminates in an open end. The open ends of all the hot legs 24 communicate with the inlet channel head 15, while the open ends of all of the cold legs 28 communicate with the outlet channel head 17. As will be better understood presently, heat from the water in the primary side 3 circulating within the U-shaped heat exchanger tubes 22 is transferred to nonradioactive feed water in the secondary side 5 of the generator 1 in order to generate nonradioactive steam.

With reference now to FIGS. 2, 3A, 3B and 3C, support plates 30 are provided to securely mount and uniformly space the heat exchanger tubes 22 within the secondary side 5. Each of the support plates 30 includes a plurality of bores 32 which are only slightly larger than the outer diameter of the heat exchanger tubes 22 extending therethrough. To facilitate a vertically-oriented circulation of the nonradioactive water within the secondary side 5, a plurality of circulation ports 35 is also provided in each of the support plates 30. Small annular spaces or crevices 37 exist between the outer surface of the heat exchanger tubes 22, and the inner surface of the bores 32. Although not specifically shown in any of the several figures, similar annular crevices 37 exist between the lower ends of both the hot and cold legs 24 and 28 of each of the heat exchanger tubes 22, and the bores of the tubesheet 7 in which they are mounted. In some types of nuclear steam generators, the openings in the support plates 30 are not circular, but instead are trifoil or quatrefoil-shaped as is illustrated in FIGS. 4A and 4B. In such support plates 30, the heat exchanger tubes 22 are supported along either three or four equidistally spaced points around their circumferences. Because such broached openings 38 leave relatively large gaps 40 at some points between the heat exchanger tubes 22 and the support plate 30, there is no need for separate circulation ports 34.

With reference back to FIGS. 1 and 2, the top portion of the secondary side 5 of the steam generator 1 includes a steam drying assembly 44 for extracting the water out of the wet steam produced when the heat exchanger tubes 22 boil the nonradioactive water within the secondary side 5. The steam drying assembly 44 includes a primary separator bank 46 formed from a battery of swirl vane separators, as well as a secondary separator bank 48 that includes a configuration of vanes that define a tortuous path for moisture-laden steam to pass through. A steam outlet 49 is provided over the steam drying assembly 44 for conducting dried steam to the blades of a turbine coupled to an electrical generator. The upper portion of the secondary side 5 includes a pair of opposing manways **50*a*, 50*b* that afford access to the separator bank 48. The middle portion of the secondary side 5 contains a tube wrapper 52 that is disposed between the tube bundle 22 and the outer shell of the steam generator 1 in order to provide a downcomer path for water extracted from the wet steam that rises through the steam drying assembly 44**.

At the lower portion of the secondary side 5, a pair of opposing sludge lance ports **53*a*, 53*b* are provided in some models of steam generators to provide access for high pressure hoses that wash away much of the sludge which accumulates over the top of the tubesheets 7 during the operation of the generator 1. These opposing sludge lance ports 53*a*, 53*b* are typically centrally aligned between the hot and cold legs 24 and 28 of each of the heat exchanger tubes 22. It should be noted that in some steam generators, the sludge lance ports are not oppositely disposed 180 degrees from one another, but are only 90 degrees apart. Moreover, in other steam generators, only one such sludge lance port is provided. In the steam generator arts, the elongated areas between rows of tubes 22 on the tubesheet 7 are known as tube lanes 54, while the relatively wider, elongated area between the hot and cold legs of the most centrally-disposed heat exchanger tubes 22 is known as the central tube lane 55. These tube lines 54 are typically an inch or two wide in steam generators whose tubes 27 are arranged in a square pitch, such as that shown in FIGS. 3A, 3B and 3C. Narrower tube lanes 54 are present in steam generators whose heat exchanger tubes 22 are arranged in a denser, triangular pitch such as shown in FIGS. 4A and 4*b*. A central tube lane 55 that is wider than the other tube lanes 54 is disposed between the sludge lance ports 53*a*, 53*b***.

During the operation of such steam generators 1, it has been observed that the inability of secondary-side water to circulate as freely in the narrow crevices 37 or gaps 40 between the heat exchanger tubes 22, and the support plates 30 and tubesheets 7 can cause the nonradioactive water in these regions to boil completely out of these small spaces, a phenomenon which is known as "dry boiling." When such dry boiling occurs, any impurities in the secondary side water are deposited in these narrow crevices 37 or gaps 38. Such solid deposits tend to impede the already limited circulation of secondary side water through these crevices 37 and gaps 38 even more, thereby promoting even more dry boiling. This generates even more deposits in these regions and is one of the primary mechanisms for the generation of sludge which accumulates over the top of the tubesheet 7. Often the deposits created by such dry boiling are formed from relatively hard compounds of limited solubility, such as magnetite, which tends to stubbornly lock itself in such small crevices 37 and gaps 38. These deposits have been known to wedge themselves so tightly in the crevices 37 or gaps 38 between the heat exchanger tubes 22 and the bores 32 of the support plates 30 that the tube 22 can actually become dented in this region.

Figure 5:
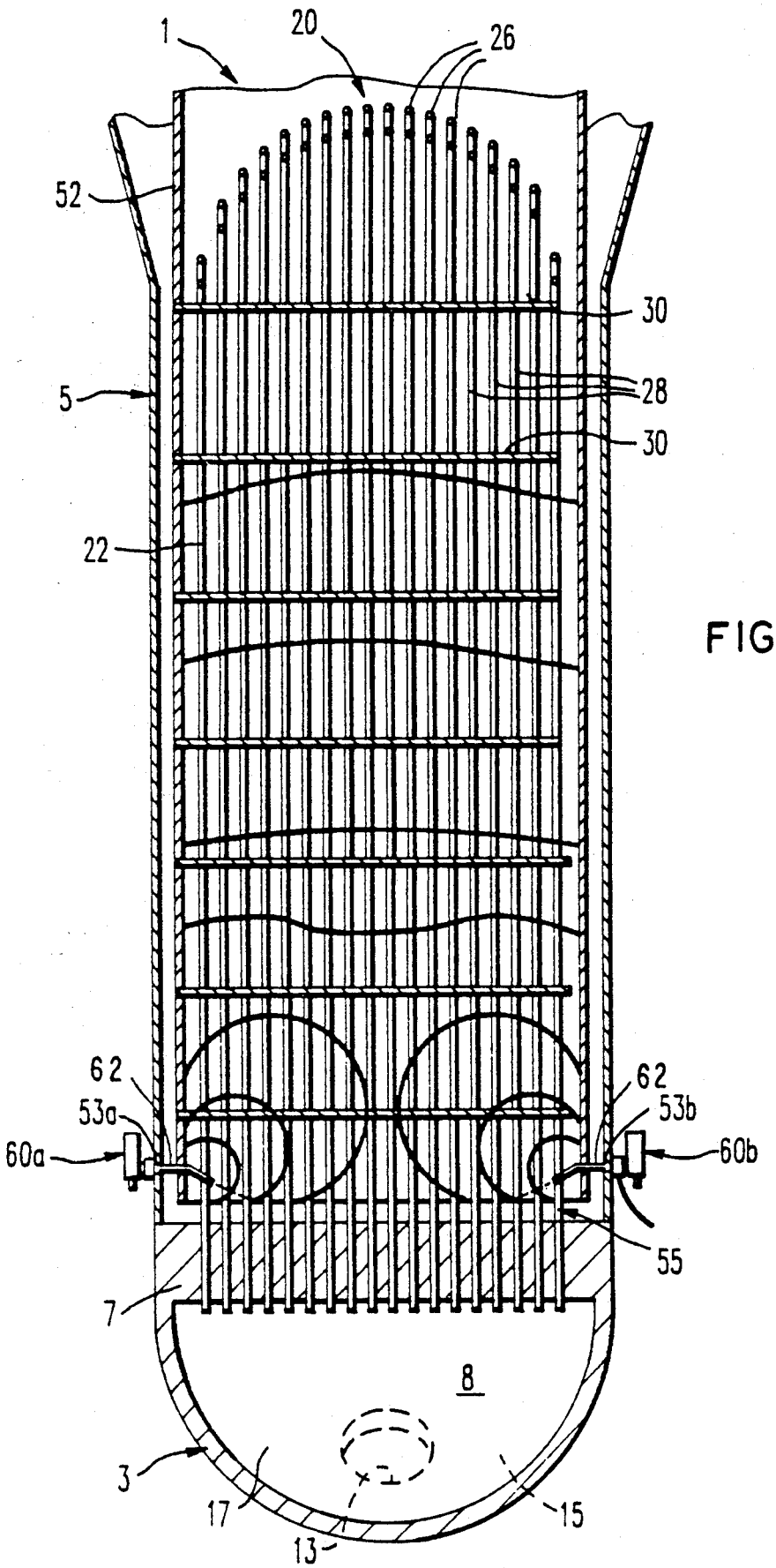
FIG. 5 is another side cross-sectional view of the steam generator illustrated in FIG. 1 along the line 5—5.

To remove these deposits, a pressure pulse cleaning system may be provided which comprises a pair of pressure pulse generator assemblies 60*a*, 60*b* having nozzles 62 mounted in the two sludge lance ports 53*a*, 53*b*, as is shown in FIG. 5. Each of the pressure generator assemblies includes a mounting flange 63 that allows it to be firmly secured over its respective port 3*a*, 53*b*. In operation, the secondary side 5 is filled with enough de-mineralized water to at least cover the tubesheet 7, the lower ends of the heat exchanger tubes 22, and the nozzles 62 of the pressure pulse generator assemblies 60*a*, 60*b*. The pressure pulse generators 60*a*, 60*b* generate a succession of pulses of pressurized gas that in turn create omnidirectional shock waves in the water contained within the secondary side 5. These shock waves loosen sludge and debris from the upper surface of the tubesheet 7, and even more importantly from the crevices 37 or gaps 38 between the best exchanger tubes 22 and the bores 32 of the support plates 30.

The instant invention is both a system 70 and method for flushing the loosened sludge and debris completely out of the interior of the secondary side 5.

System of the Invention

Figure 3A:
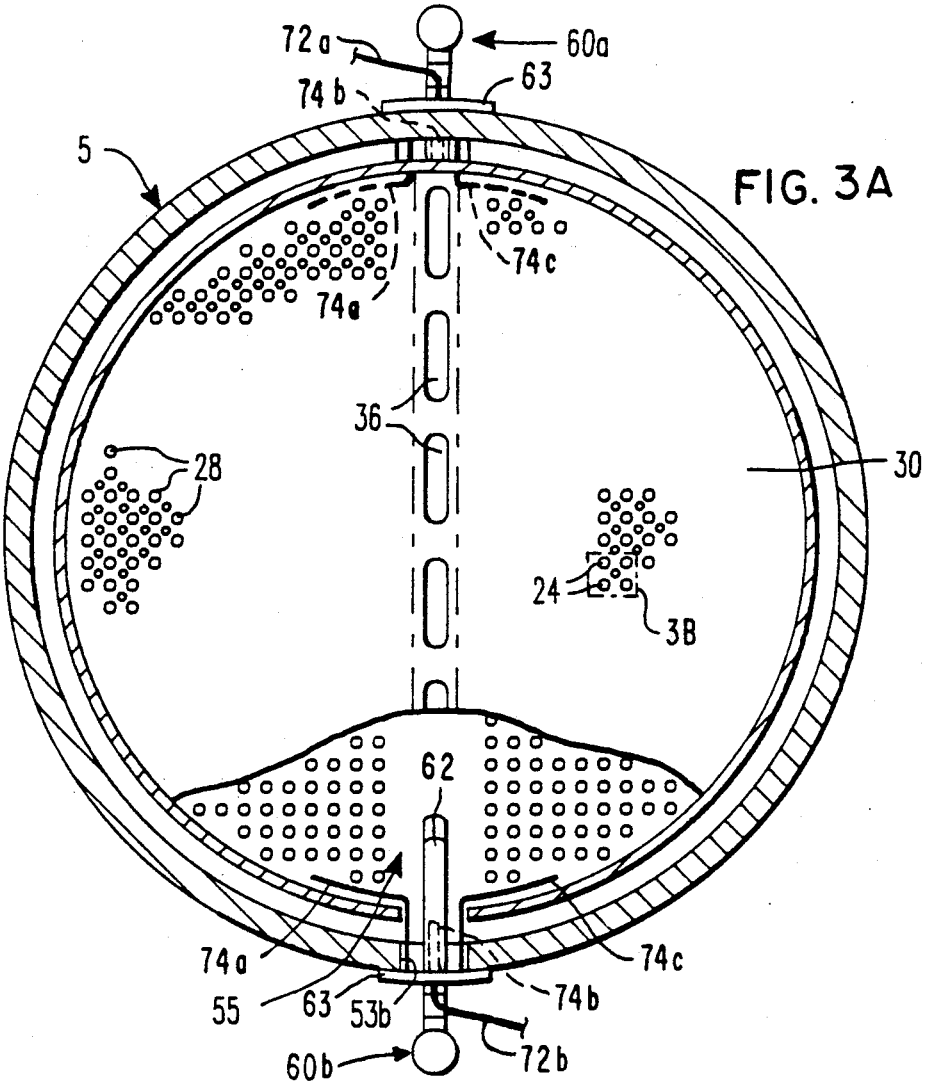
FIG. 3A is a plan cross-sectional view of the steam generator illustrated in FIG. 1 along the line 3A—3A, illustrating the manner in which the suction nozzles of the system are mounted through the sludge lance ports located at the bottom of the secondary side.
Figure 3B:
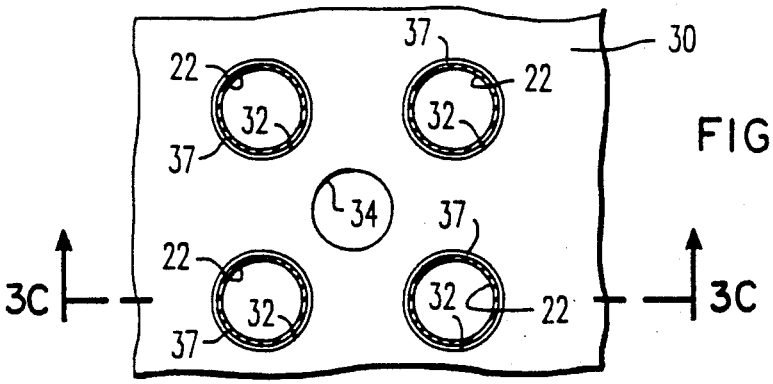
FIG. 3B is an enlargement of the portion of the support plate illustrated in FIG. 3A that is enclosed in dotted lines.
Figure 3C:
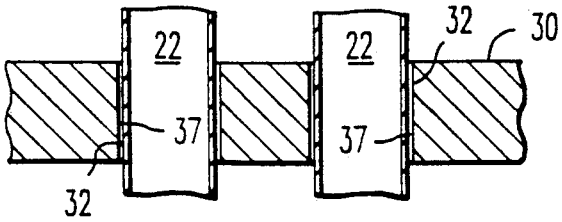
FIG. 3C is a side cross-sectional view of the section of support plate illustrated in FIG. 3B along the line 3C—3C.
Figure 4A:
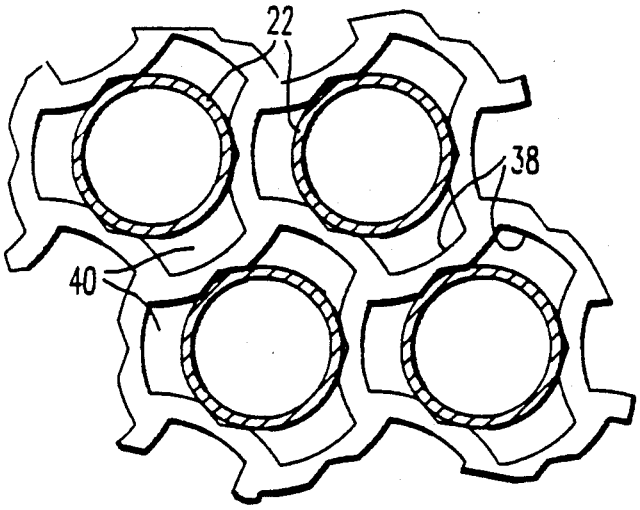
FIG. 4A is a plan view of a section of a broached trifoil support plate, illustrating the relatively large gaps between the heat exchanger tubes of the generator and the trifoil openings.
Figure 4B:
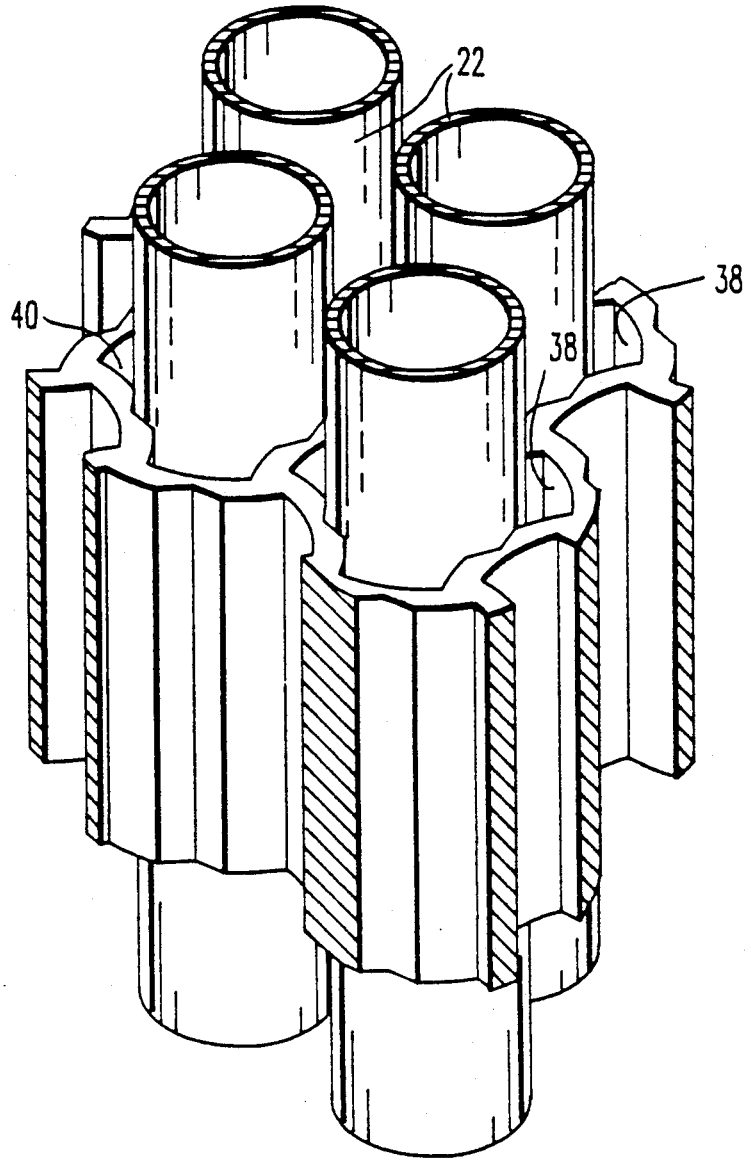
FIG. 4B is a perspective view of the broached trifoil support plate illustrated in FIG. 4A.
Figure 6:
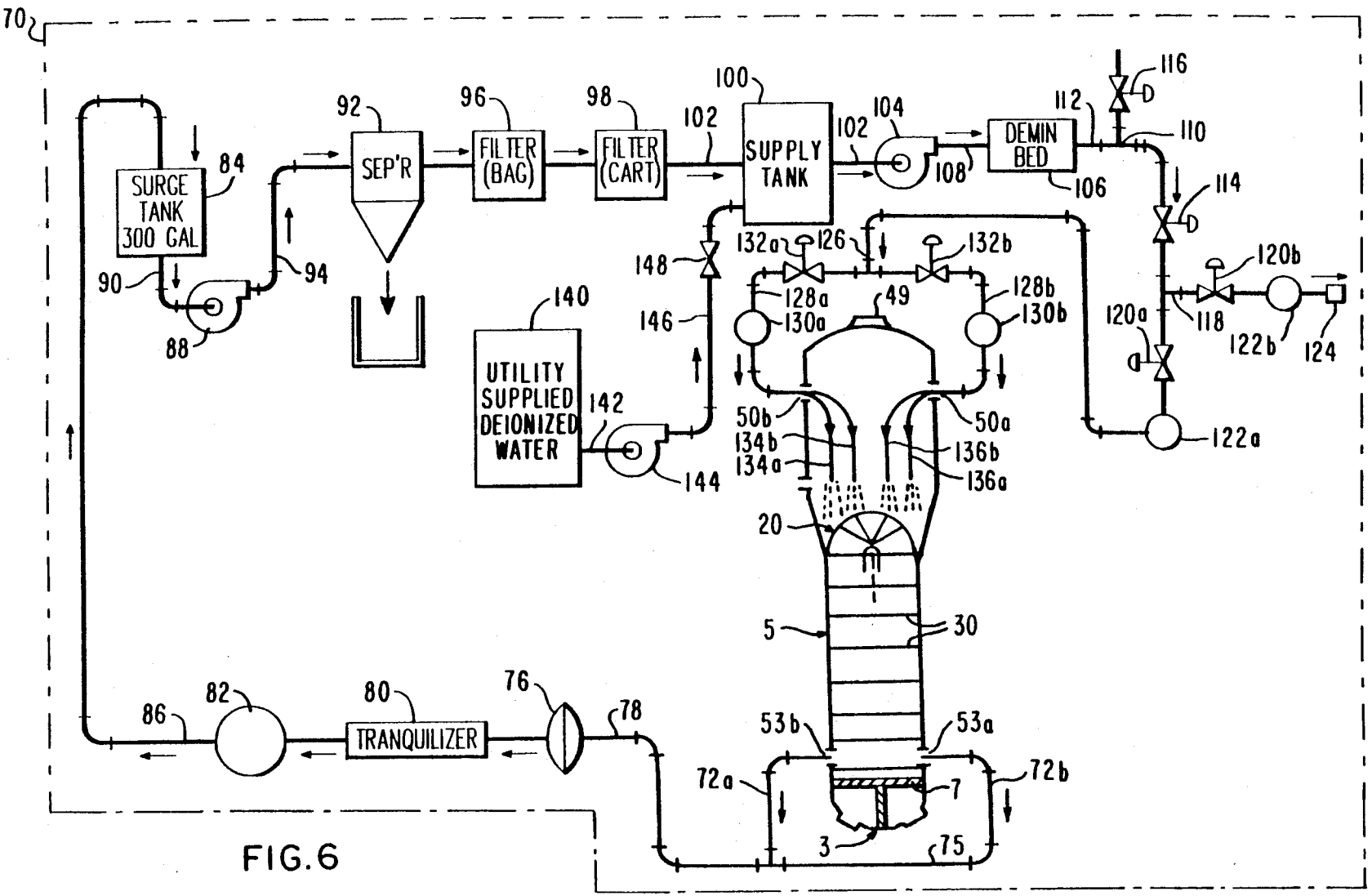
FIG. 6 is a schematic view of the flushing and recirculation systems of the invention.

With reference now to FIGS. 3A and 6, the system of the invention comprises a vertical flush and recirculation system 70 for both draining and filling the secondary side 5 with clean, de-ionized water while vertically flushing the tube bundle 28 and tubesheet 7 with a forceful spray of water. As is best seen in FIG. 3A, the system 70 includes a pair of suction hoses 72*a*, 72*b* that extend through the circular mounting flange 63 of each of the pressure pulse generator assemblies 60*a*, 60*b* by way of a fitting the distal end of each of these hoses is connected to three suction nozzles 74*a*, 74*b* and 74*c* which lie on top of the tubesheet 7. Nozzles 74*a* and 74*c* are aligned along the periphery of the tubesheet 7 while nozzle 74*b* is aligned along the central tube lane 55 in order to rapidly draw off water from a broad section of the top surface of the tubesheet 7. Each of the nozzles 74*a*, 74*b* and 74*c* is approximately 1.5–2.0 inches (4–5.25 cm) in diameter.

As is best seen in FIG. 6, the proximal ends of each of the suction hoses 72*a*, 72*b* are connected to a manifold 75 which is in turn connected to the inlet of a diaphragm pump 76 by way of conduit 78. The use of a diaphragm-type pump 76 is preferred at this point in the flushing and recirculation system 70 since the water withdrawn through the suction hoses 72*a*, 72*b* may have large particles of suspended sludge which, while easily handled by a diaphragm-type pump, could damage or even destroy a rotary or positive displacement-type pump. The output of the diaphragm pump 76 is in turn serially connected to first a tranquilizer 80 and then a flow meter 82. The tranquilizer 80 "evens out" the pulsations of water created by the diaphragm pump 76 and thus allows the flow meter 82 to display the average rate of the water flow out of the diaphragm pump 76. The output of the flow meter 82 is connected to the inlet of a surge tank 84 via conduit 86. In the preferred embodiment, the surge tank 84 has an approximately 300 gallon (1200 liter) capacity. The outlet of the surge tank 84 is connected to the inlet of a flow pump 88 by way of a single conduit 90, while the output of the pump 88 is connected to the inlet of a cyclone separator 92 via conduit 94. In operation, the surge tank 84 accumulates the flow of water generated by the diaphragm pump 76 and smoothly delivers this water to the inlet of the pump 88. the pump 88 in turn generates a sufficient pressure head in the recirculating water so that a substantial portion of the sludge suspended in the water will be centrifugally flung out of the water as it flows through the cyclone separator 92.

Located downstream of the cyclone separator 92 is a one to three micron bag filter 96 that is serially connected to a one micron cartridge filter 98. These filters 96 and 98 remove any small particulate matter which still might be suspended in the water after it passes through the cyclone separator 92. Downstream of the filters 96 and 98 is a 500 gallon (2000 liter) supply tank 100 that is connected to the outlet of filter 98 by conduit 102. Supply tank 100 is connected to an outlet conduit 102 that leads to the inlet of another flow pump 104. The outlet of the flow pump 104 is in turn connected to the inlet of a de-mineralizer bed 106 by way of conduit 108. The purpose of the flow pump 104 is to establish enough pressure in the recirculating water so that it flows through the serially connected ion exchange columns (now shown) in the de-mineralizer bed 106 at an acceptably rapid flow rate. To this end, the power capacity of flow pump 104 is preferably somewhere between 200 and 400 hp. The purpose of the de-mineralizer bed 106 is to remove all ionic species from the water so that they will have no opportunity to re-enter the secondary side 5 of the generator 1 and create new sludge deposits.

Located downstream of the de-mineralizer bed 106 is a first T-joint 110 whose inlet is connected to conduit 112 as shown. An isolation valve 114 and a drain valve 116 are located downstream of the two outlets of the T-joint 110 as shown to allow the water used in the cleaning method to be drained into the decontamination facility of the utility. Located downstream of the T-joint 110 is another T-joint 118 whose inlet is also connected to conduit 112 as shown. Diverter valves 120*a* and 120*b* are located downstream of the outlet of T-joint 110 as indicated. Normally valve 120*a* is open and valve 120*b* is closed. However, if one desires to fill a second steam generator with the filtered and polished water drained from a first steam generator in order to expedite the pressure pulse cleaning method, valves 120*a* and 120*b* can be partially closed and partially opened, respectively. Flowmeters 122*a*, 122*b* are located downstream of the valves 120*a* and 120*b* so that an appropriate bifurcation of the flow from conduit 112 can be had to effect such a simultaneous drain-fill step. Additionally, the conduit that valve 120*b* and flowmeter 122*b* are mounted in terminates in a quick-connect coupling 124. To expedite such a simultaneous drain-fill step, valves 120*a* and 120*b* are mounted on a wheeled cart (not shown) and conduit 112 is formed from a flexible hose to form a portable coupling station.

Downstream of the portable coupling station, inlet conduit 112 terminates in the inlet of a T-joint 126 that bifurcates the inlet flow of water between inlet conduits 128*a* and 128*b*. Inlet conduits 128*a* and 128*b* each include flowmeters 130*a*, 130*b* to help the system operator adjust flow valves 132*a*, 132*b* so that the flow of water from conduit 112 is evenly divided through inlet conduits 128*a* and 128*b*. With reference now to FIGS. 1 and 6, each of the inlet conduits 128*a* and 128*b* is connected to a manifold (not shown) that is mounted on the covers 50.5*a* and 50.5*b* of the manways 50*a* and 50*b*. Each of these manifolds is in turn fluidly connected to a pair of flexible spray nozzles 134*a,b* and 136*a,b*, respectively. The flexible nozzles extend through the primary separator bank 46 so that their open distal ends are suspended over the tube bundle 20 a distance of about 6–10 inches (15.72–26.20 cm). In the preferred embodiment, the four nozzles 134*a,b* and 136*a,b* are roughly arranged in a square configuration over the tube bundle 20 so that the streams of water discharged therefrom uniformly strike the top portion of the tube bundle 20. To minimize back pressure, the nozzles 134*a,b* and 136*a,b* are 1.5–2.0 inches (4.0–5.25 cm) in diameter. Additionally, the nozzles 134*a,b* and 136*a,b* are each formed from a conduit material that is flexible enough so that the reaction forces generated by the pressurized streams of water discharged from its open distal end causes it to whip around in a more or less random pattern, which in turn renders the distribution of sprayed water even more uniform over the top of the tube bundle 20.

Water is initially supplied to the flushing and recirculation system 70 through de-ionized water supply 140, which may be the de-ionized water reservoir of the utility being serviced Water supply 140 includes an outlet conduit 142 connected to the inlet of another flow pump 144. The outlet of the flow pump 144 is connected to another conduit 146 whose outlet is in turn connected to the supply tank 100. A check valve 148 is provided in conduit 146 to insure that water from the supply tank 100 cannot back up into the deionized water supply 140.

Method of the Invention

In the first step of the method of the invention, the flushing and re-circulation system 70 illustrated in FIG. 6 is installed onto the secondary side 5 of a nuclear steam generator 1. This is accomplished by bolting the mounding flanges 63 of the pressure pulse generators 60*a*, 60*b* over the sludge lancing ports 53*a* and 53*b* located in the bottom portion of the secondary side 5. This has the effect of positioning the suction nozzles 74*a*, 74*b* and 74*c* that are mounted onto to each of the pressure pulse generator 60*a*, 60*b* into the position illustrated in FIG. 3A, wherein nozzles 74*a* and 74*c* are oriented along the periphery of the tubesheet 7 inside of the tube wrapper 52, and nozzle 74*b* is oriented along the main tube lane 55. At the same time, the outlet ends of the flexible spray nozzles 134*a, b* and 136*a, b* are manipulated into the position illustrated in FIG. 1, wherein each of these nozzles is suspended less than a foot (30 cm) above the upper end of the tube bundle 20. These spray nozzles 134*a, b* and 136*a, b* are secured in place when the special manway covers 50.5*a*, 50.5*b* that include the previously mentioned manifolds are secured over the manways 50*a* and 50*b*.

In the next step of the method, flow pump 144 is actuated to fill supply tank 100 with purified and deionized water from water supply 140. After supply tank 100 has been filled with a sufficient amount of water from the water supply 140, flow pump 104 is actuated with valves 114 and 120*a* open and valve 120*b* closed in order to introduce this de-ionized water into the inlet conduits 128*a* and 128*b*. At this juncture, flow valves 132*a* and 132*b* are adjusted so that the flow through each of these conduits 128*a* and 128*b* is substantially equal. The introduction of water into these conduits forces water through the flexible spray nozzles 134*a, b* and 136*a, b*, which in turn flows through the tube bundle 20 and support plates 30 and collects over the top surface of the tubesheet 7. When sufficient water has collected within the secondary side 5 so that the nozzles 62 of each of the pressure pulse generators 60*a* and 60*b* are immersed under at least about 1 foot (32 cm.) of water, the system operator actuates the pressure pulse generators so that they commence firing a succession of pressurized pulses of gas into the collected water. The shock waves generated within this water in turn impinges on the upper side of the tubesheet 7 in the lower ends of the heat exchanger tubes 22, thereby loosening sludge and debris that has collected thereon.

Soon after pressure pulse generators 60*a* and 60*b* have been actuated, diaphragm pump 76 is started so that the suction nozzles 74*a*, 74*b* and 74*c* connected to the suction hoses 72*a* and 72*b* start to suck out the water that has collected within the secondary side 5. In the preferred method of the invention. the diaphragm pump 76 pulls out approximately 40 gallons of water per minute from each of the suction hoses 72*a* and 72*b*. At the same time, the flow pump 104 is adjusted so that each of the inlet conduits 128*a* and 128*b* introduces approximately 50 gallons of water per minute through the flexible spray nozzles 134*a,b* and 136*a,b*. The vertical flushing action of the water sprayed over the top of the tube bundle 20 and downwardly into the tubesheet 7 in combination with the suction afforded through the nozzle 74*a*, 74*b* and 74*c* connected to the suction hoses 72*a* and 72*b* creates a flow of water that is sufficiently rapid to entrain and sweep away sludge and debris that is loosened by the shock waves generated by the pressure pulse generators 60*a* and 60*b*.

Since the flow rate of water through the inlet conduits 128*a* and 128*b* is about 20 gallons per minute faster than the outflow of water through the suction hoses 72*a* and 72*b*, the level of water steadily rises upwardly through the secondary side 5 as the pressure pulse generators 60*a* and 60*b* continue to generate shock waves which impinge upon the tubesheet 7, the heat exchanger tubes 22 and the support plates 30. In the preferred method of the invention, the flushing and recirculation system 70 continues to operate in this mode until the tube bundle 20 is completely submerged in water. Depending upon the amount of sludge that has accumulated in the secondary side 5 of the steam generator 1 being cleaned, this step of the method of the invention may take anywhere between 12 and 20 hours. All during this step of the method, the sludge-containing water discharged through the suction hoses 72*a* and 72*b* is purified by the cyclone separator 92, the filter bag 96, the cartridge filter 98, and the demineralizer bed 106 before being re-introduced into the steam generator 1 through the inlet conduits 128*a* and 128*b*. When the secondary side 5 is completely filled with water, the system 70 will contain approximately 20,000 gallons of water, 18,000 of which is disposed within the secondary side 5 of the steam generator 1, and 2,000 gallons of which is in the pipelines and tanks of the balance of the flushing and re-circulation system 70.

Once the secondary side 5 is filled to the extent that the top of the tube bundle 20 is completely submerged in water, the operation of the diaphragm pump 76 is speeded up in order to increase the suction flow through the suction hoses 72*a* and 72*b* from 80 gallons to 100 gallons per minute thereby equalizing it the rate at which water is suctioned off from the secondary side 5 to the rate at which water is introduced into the secondary side 5 through the inlet conduits 28*a* and 28*b*. In this manner, the level of the water within the secondary side 5 is maintained at equilibrium above the tube bundle 20 for preferably between 6 and 8 hours, during which the pressure pulse generator 60*a* and 60*b* continue to be operated. The increased rate of suction in combination with the continuous pounding of the sludge by the shock waves generated by the pulses of pressurized gas and the vertical flow currents induced by the inlet nozzles 134*a,b* and 136*a,b* causes the loosening and removal of a great deal of sludge from the interior of the secondary side 5.

In the final step of the method of the invention, the water inside the secondary side 5 of the steam generator 1 is slowly drained by reducing the flow of water through the inlet conduits 128*a* and 128*b* from 100 gallons per minute to 80 gallons per minute. This results in a net loss of 20 gallons per minute of water from the secondary side 5. At the beginning of this step, diverter valve 120*b* is partially opened while diverter valve 120*a* is partially closed in order to divert some of the 20,000 gallons of water which has accumulated into the system 70 back to the utility through quick disconnect coupling 124.

Like the previously described secondary side filling step, this draining step lasts between about 12 and 20 hours, depending upon the condition of the secondary side 5 of the steam generator 1. It is during this step that the forceful spray of water emitted by the four spray nozzles 134*a,b* and 136*a,b* is the most effective in removing sludge from the tube bundle 20, as a great deal of the sludge has been loosened by the succession of shock waves generated by the succession of pressurized pulses of gas emitted by the pressure pulse generator 60*a* and 60*b*. In particular, the steady downstream of water from these nozzles 134*a,b* and 136*a,b* runs through the annular spaces and gaps 37 and 40 existing between the heat exchanger tubes 22 and the bores which surround them and the support plate 30, thereby effectively pushing this sludge and debris downwardly to the top surface of the tubesheet 7 where it is entrained and swept away by the water flowing through the suction nozzles 74*a*, 74*b* and 74*c*. Of course, the pressure pulse generators 60*a* and 60*b* continue to be operated at all times through this draining step.

When the level of water in the secondary side 5 is no longer sufficient to cover the nozzles 62 of the pressure pulse generators 60*a* and 60*b*, the generators 60*a* and 60*b* are de-actuated. All the remaining water in the secondary side 5 is then removed, and both the pressure pulse generators 60*a* and 60*b* and the special manway covers 50.5*a*, 50.5*b* which cover the manways 50*a* and 50*b* are removed in the reverse order of their installation.

We claim:

1. A method for loosening and removing sludge and debris from the interior of the vessel of a heat exchanger having a top portion and a bottom portion and that contains one or more heat exchanger components, comprising the steps of:

a. introducing a sufficient amount of liquid in said heat exchanger vessel to submerge at least a portion of the interior thereof that includes some of said sludge, debris and heat exchanger components;

b. generating a succession of shock waves within the liquid to loosen said sludge and debris, and c. vertically flushing the interior of the vessel by suctioning off said liquid from the bottom portion of said vessel while simultaneously introducing liquid into the top portion of said vessel.

2. A method for loosening and removing sludge and debris as defined in claim 1, wherein said succession of shock waves continues to be generated within said liquid while the interior of the vessel is vertically flushed.

3. A method for loosening and removing sludge and debris as defined in claim 1, wherein the rate of suctioning off liquid out of the vessel is substantially the same as the rate of introducing liquid into the vessel.

4. A method for loosening and removing sludge and debris as defined in claim 1, wherein the same liquid suctioned off from the bottom portion of the vessel is recirculated to the top portion of the vessel.

5. A method for loosening and removing sludge and debris as defined in claim 4, further including the step of removing substantially all of the sludge and debris entrained in the liquid suctioned off from the bottom portion of the vessel before recirculating it back through the top portion of the vessel.

6. A method for loosening and removing sludge and debris as defined in claim 1, wherein the liquid introduced into the top portion of the vessel is forcefully sprayed over the interior of the vessel.

7. A method for loosening and removing sludge and debris as defined in claim 6, wherein said sprayed liquid is directed over said heat exchanger components to remove loosened sludge and debris from said components.

8. A method for loosening and removing sludge and debris as defined in claim 1, wherein said heat exchanger vessel is filled by introducing liquid into the top portion of the vessel faster than said liquid is suctioned off from the bottom portion of said vessel.

9. A method for loosening and removing sludge and debris as defined in claim 8, wherein said heat exchanger vessel is drained after being filled by suctioning off liquid from the bottom portion of the vessel faster than said liquid is introduced into the top portion of said vessel.

10. A method for loosening and removing sludge and debris as defined in claim 8, wherein between about 70 to 90 per cent of the liquid introduced into the top portion of the vessel is removed by suctioning off said liquid from the bottom portion of the vessel.

11. A method for loosening and removing sludge and debris from the interior of the secondary side of a steam generator having a top portion and a bottom portion and that contains a tubesheet and plurality of heat exchanger tubes and support plates, comprising the steps of:

a. introducing a sufficient amount of water in secondary side to submerge at least the tubesheet;

b. generating a succession of pressure pulses within the water by means of pulses of pressurized gas to create shock waves that loosen sludge and debris, and c. vertically flushing the interior of the secondary side by suctioning off said water from the bottom portion while simultaneously introducing liquid into the top portion.

12. A method for loosening and removing sludge and debris as defined in claim 11, wherein said pulses of pressurized gas are introduced directly into said water, and said debris and sludge loosening shock waves are in the form of fountains of water erupting above the surface of the water that forcefully slap against the heat exchanger tubes and support plates.

13. A method for loosening and removing sludge and debris as defined in claim 11, wherein said debris and sludge loosening shock waves are in the form of projectiles or water discharged below the surface of the water that impinge on the tubesheet, heat exchanger tubes and support plates within the secondary side of the steam generator.

14. A method for loosening and removing sludge and debris as defined in claim 11, wherein said pulses of pressurized gas are introduced directly into said water, and said debris and sludge loosening shock waves are in the form of omnidirectional shock waves of water located below the surface of the water that impinge on the tubesheet, heat exchanger tubes and support plates within the secondary side of the steam generator.

15. A method for loosening and removing sludge and debris as defined in claim 11, wherein the secondary side of the generator is filled with enough water to completely submerge the heat exchanger tubes by introducing water into the top portion of the secondary side at a rate faster than said water is suctioned off from the bottom portion of the secondary side, and wherein said succession of pressure pulses continues to be introduced into said water as said secondary side is filled.

16. A method for loosening and removing sludge and debris as defined in claim 15, wherein filling rate is between about 20 and 30 per cent higher than said draining rate.

17. A method for loosening and removing sludge and debris as defined in claim 15, wherein said secondary side is filled at a rate of about 100 gpm and suctioned off at a rate of about 80 gpm.

18. A method for loosening and removing sludge and debris as defined in claim 15, wherein the secondary side of the generator is drained after being filled with enough water to submerge said heat exchanger tubes by suctioning off water out of said secondary side at a rate faster than said water is introduced into said secondary side, and wherein said succession of pressure pulses continues to be introduced into said water as said secondary side is drained.

19. A method for loosening and removing sludge and debris as defined in claim 18, wherein the suctioning rate is between about 20 and 30 per cent higher than the rate at which water is introduced into the secondary side.

20. A method for loosening and removing sludge and debris as defined in claim 18, wherein said secondary side is suctioned off at a rate of about 100 gpm while water is introduced at a rate of about 80 gpm.

21. A method for loosening and removing sludge and debris as defined in claim 11, wherein the same water suctioned off from the secondary side is recirculated back through the top portion of the secondary side after substantially all of the sludge and debris entrained in said water has been removed.

22. A method for loosening and removing sludge and debris as defined in claim 11, wherein the water introduced into the top portion of the secondary side is forcefully sprayed over the tubesheet and heat exchanger tubes to help remove loosened sludge and debris from said tubesheet and tubes.

23. A method for loosening and removing sludge and debris as defined in claim 18, wherein said introducing rate exceeds said suctioning off rate for between about 12 and 20 hours, and said introducing rate substantially equals said suctioning off rate for between about six and eight hours, and said suctioning off rate exceeds said introducing rate for between about 12 and 20 hours.

24. A method for loosening and removing sludge and debris as defined in claim 21, wherein substantially all ionic species dissolved in the water drained from the bottom portion of the secondary side is removed before said water is recirculated back through the upper portion of the secondary side.

25. A method for loosening and removing sludge and debris from the interior of the secondary side of a nuclear steam generator that contains a tubesheet at its bottom portion, and a plurality of heat exchanger tubes that extend from its bottom portion to its top portion, comprising the steps of:

a. introducing a sufficient amount of water into said secondary side to immerse said tubesheet and the lower ends of said heat exchanger tubes;

b. generating a succession of pressure pulses within the water collected within the secondary side with pulses of pressurized gas to create shock waves that loosen sludge and debris;

c. vertically flushing the interior of the secondary side by suctioning out water from the bottom portion while simultaneously forcefully spraying water from the top portion over said tubesheet and said heat exchanger tubes to remove and entrain sludge and debris loosened by said shock waves;

d. filling said secondary side with sufficient water to completely immerse said heat exchanger tubes by introducing more water at the top portion than is suctioned out at the bottom portion, and e. draining said secondary side of water by suctioning out more water at the bottom portion than is introduced at said top portion, wherein said succession of pressure pulses continues throughout steps c, d and e.

26. A system for loosening and removing sludge and debris from the interior of the vessel of a heat exchanger having top and bottom portions and containing one or more heat exchanger components immersed in a liquid, comprising:

a. means for generating a succession of pressure pulses to create shock waves in said liquid to loosen said sludge and debris, and b. means for vertically flushing said heat exchanger components while said pressure pulse means creates sludge loosening shock waves.

27. A system for loosening and removing sludge and debris as defined in claim 26, wherein said vertical flushing means includes a suction means for suctioning liquid out of the bottom portion of the vessel, and a nozzle means for introducing liquid into the top portion of the vessel at the same time said suctioning means removes liquid from said vessel.

28. A system for loosening and removing sludge and debris as defined in claim 26, wherein said vertical flushing means also functions to vary the level of liquid within said vessel.

29. A system for loosening and removing sludge and debris as defined in claim 27, wherein said nozzle forcefully sprays liquid over said heat exchanger components to remove sludge and debris loosened by said shock waves.

* * * * *